United States Patent [19]

Wren

[11] 4,311,408

[45] Jan. 19, 1982

[54] SIDE DELIVERY ATTACHMENT FOR SPREADER TRUCK

[76] Inventor: Lawrence D. Wren, Rte. 3, Box 568, Corvallis, Oreg. 97330

[21] Appl. No.: 46,381

[22] Filed: Jun. 7, 1979

[51] Int. Cl.[3] ..... E01C 19/20

[52] U.S. Cl. ..... 404/104; 404/110; 298/24

[58] Field of Search ..... 404/104, 110, 84; 298/24; 239/664, 668, 672

[56] References Cited

U.S. PATENT DOCUMENTS

| | | | |
|---|---|---|---|
| 2,660,937 | 12/1953 | Breeden | 404/104 |
| 2,848,930 | 8/1958 | Thompson | 404/104 |
| 3,109,351 | 11/1963 | Dunn | 404/104 |
| 3,109,352 | 11/1963 | Mack | 404/110 |
| 3,130,654 | 4/1964 | Apel | 404/104 |
| 3,330,188 | 7/1967 | Layton | 404/104 |
| 3,453,939 | 7/1969 | Pollitz | 404/84 |
| 3,856,425 | 12/1974 | Miller | 404/84 |
| 4,188,152 | 2/1980 | Kitt | 404/110 |

OTHER PUBLICATIONS

U.S.D.O.T. Publication "Shoulder Maintenance", 5/1977.

*Primary Examiner*—Nile C. Byers, Jr.

*Attorney, Agent, or Firm*—Klarquist, Sparkman, Campbell, Leigh, Whinston & Dellett

[57] ABSTRACT

A side delivery attachment for a spreader truck which converts it from a spreader to an apparatus for applying crushed rock in measured amounts accurately to a desired strip of the shoulder of a road.

6 Claims, 6 Drawing Figures

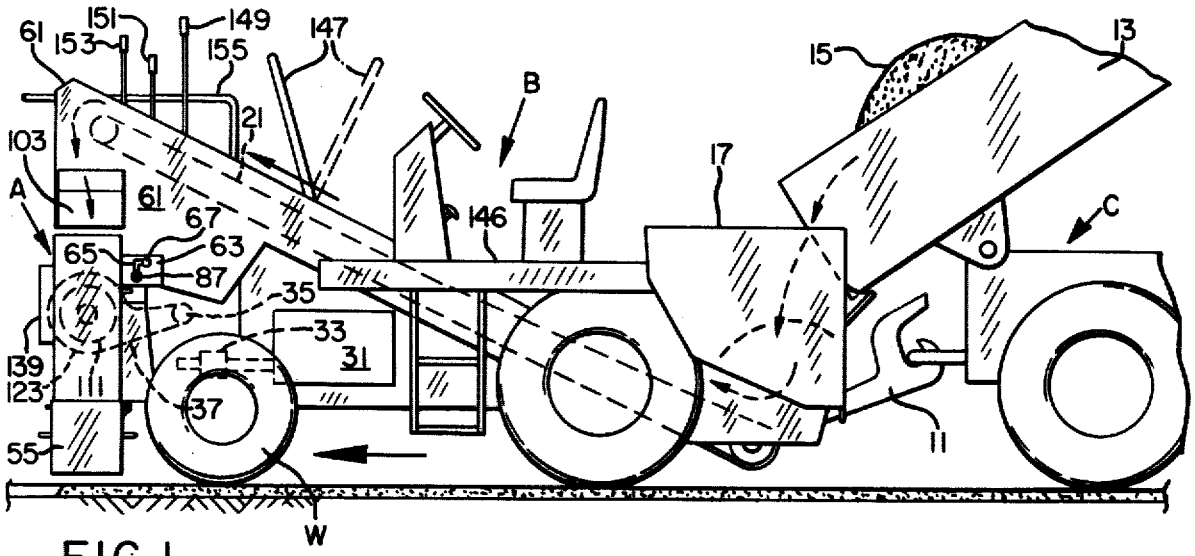
FIG. 1
FIG. 2
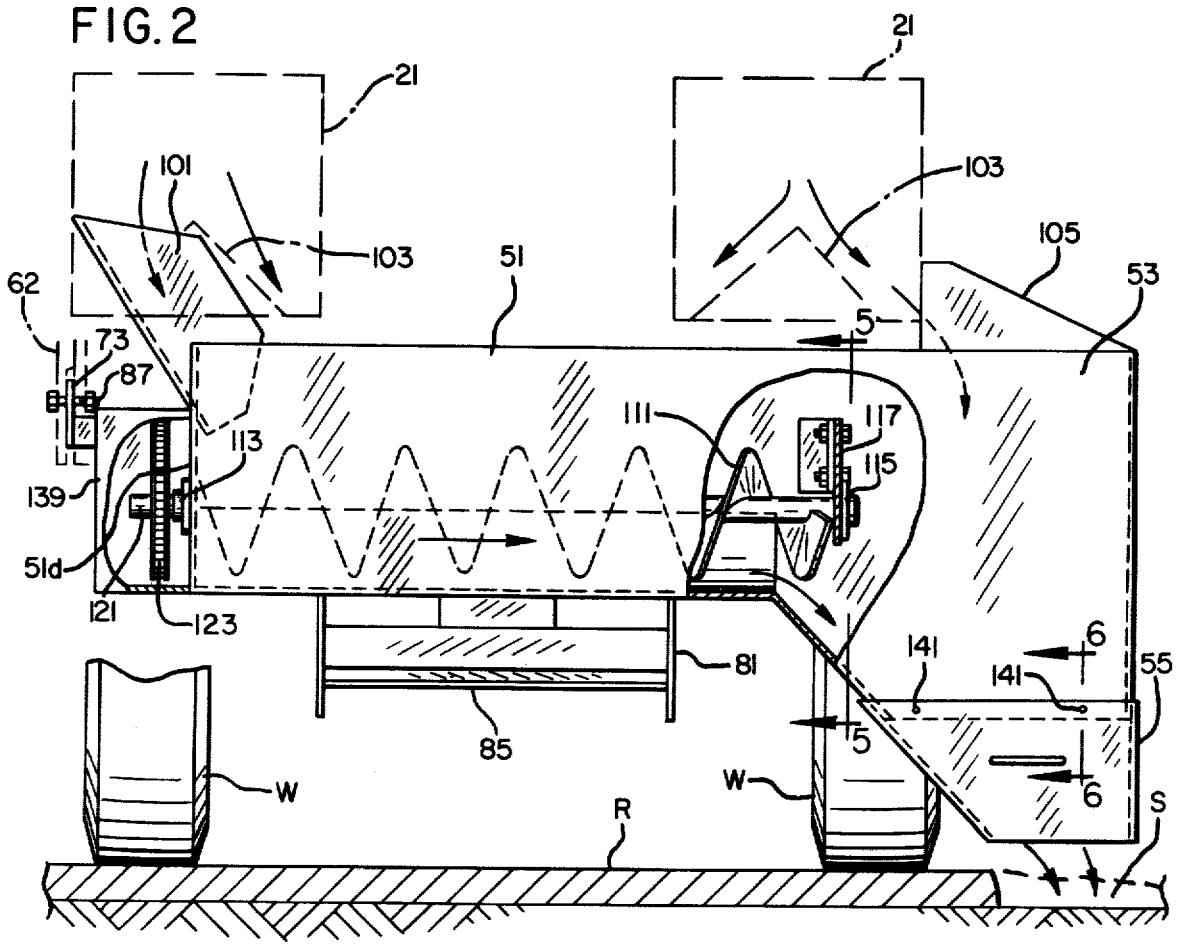

SIDE DELIVERY ATTACHMENT FOR SPREADER TRUCK

BACKGROUND OF THE INVENTION

At present, it is common practice when applying crushed rock to a shoulder of a road, to utilize a dump truck which is driven along straddling the shoulder while the driver attempts to time the elevation of the dump body so as to deposit the desired amount of rock in the area of the shoulder. The control over the amounts applied vary widely, and part of the rock is deposited on the roadway, and part outward of the portion of the shoulder next to the roadway (such portion sometimes called hereinafter "adjacent shoulder"). The rock on the roadway must be removed, while that scattered over the shoulder beyond the adjacent shoulder is wasted. Even the portion of the rock deposited on the adjacent shoulder needs to be reworked, frequently by hand. The above procedure is obviously time consuming and wasteful.

SUMMARY OF THE INVENTION

The present invention provides a side delivery attachment for an existing spreader truck to convert it from a rock spreading implement to one for applying the crushed rock in desired regulated quantities, accurately to an adjacent shoulder of road. The attachment is so designed that once a spreader attachment is removed from the spreader truck, the side delivery attachment of the present invention can be mounted as a replacement unit, requiring only minor modification or alteration of the existing structure. Yet my attachment operates efficiently and effectively to overcome the problems above alluded to.

An object of the present invention is to provide an apparatus for applying crushed rock in measured quantities accurately to an adjacent shoulder of a road.

Another object of the invention is to provide an attachment which is designed so that it can quickly replace the spreader attachment on a spreader truck requiring only minor modification or alteration of the spreader truck.

The subject matter which I regard as my invention is particularly pointed out and distinctly claimed in the concluding portion of this specification. The invention, however, both as to organization and method of operation, together with further advantages and objects thereof, may be best understood by reference to the following description, taken in connection with the following drawings, wherein like reference characters refer to like elements.

DESCRIPTION OF THE DRAWINGS

FIG. 1 is a side elevational view of a rig incorporating the side delivery attachment of the present invention;

FIG. 2 is a front elevational view of the attachment with parts broken away for convenience in illustration;

FIG. 1 shows my side delivery attachment at A, mounted at the front end of a powered, steerable, crushed rock handling truck B of known construction. Truck B is designed to have mounted on it a conventional crushed rock spreader (not shown) which would be located at the place of my attachment and thus mounted on the front end of the truck B. The truck is adapted by a hitch 11 to be connected to a dump truck C, the tilting body 13 of which dumps a load of crushed rock 15 into a bin portion 17 of the truck B. A side shifting mechanism (not shown) in the bin is arranged to side shift the crushed rock so that it is delivered to a pair of laterally spaced upwardly inclined conveyors 21 (compare FIGS. 1 and 2). The conveyors dump the crushed rock into the spreader, which has a metering mechanism to deliver a curtain of rock to the underlying surface, this being a step in a conventional road building process.

Figure 3:
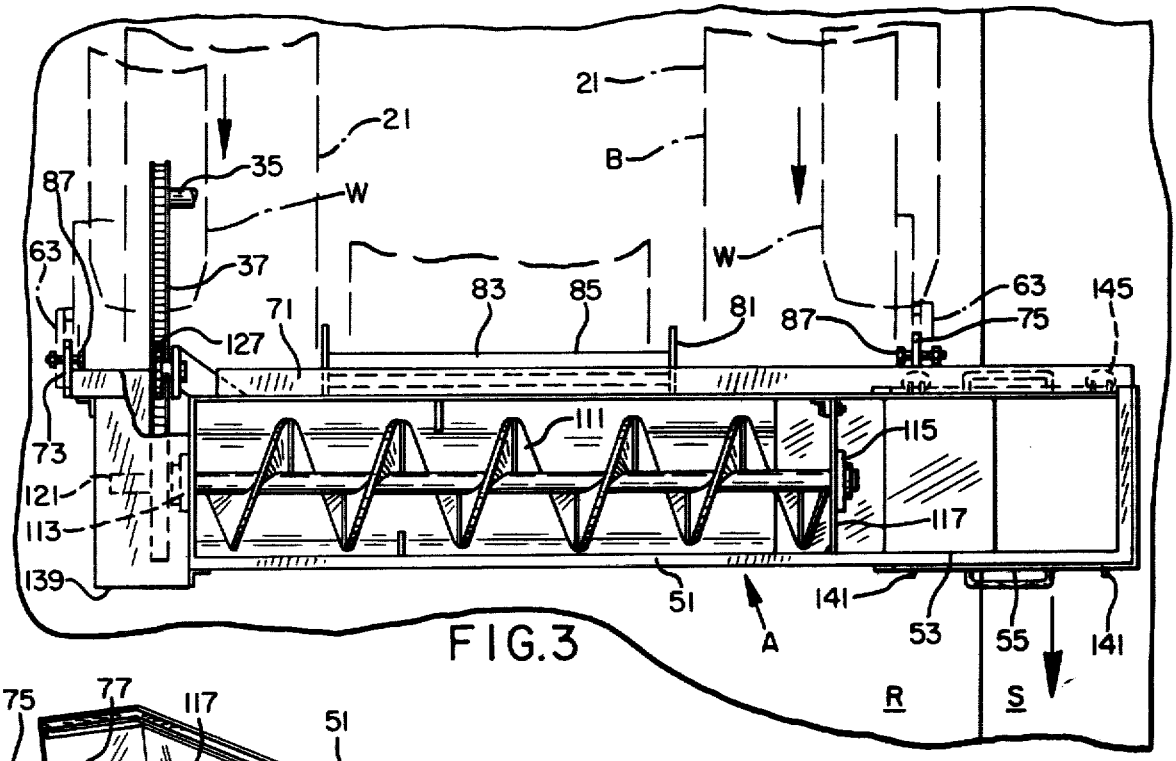
FIG. 3 is a plan view of the attachment.

My attachment A is designed to mount in the same place as the conventional spreader and to coact with the conveyors 21, requiring only minor modification of the truck B. Thus, when it is desired to effect spreading operations, the rock spreader is mounted on the front of truck B. When it is desired to dump rock on the adjoining shoulder of a road, the rock spreader is removed and replaced by my attachment A, which functions to dump rock on the shoulder S (FIG. 2) of the road R. When it is later desired to effect a spreading operation my attachment can be readily removed and replaced by the conventional rock spreader.

In order to avoid confusion in terminology as to "front", and "rear", the rig shown in FIG. 1, whether equipped with a conventional rock spreader or my inventive attachment will move from right to left in the direction of the arrow. Thus, the left hand end of the truck B is its front end. However, the truck is coupled to the rear end of the dump truck C, but during the operation of the truck B, the rig will always be moving from right to left and thus the dump truck C will be moving rearwardly as regards its front end and rear end. Typically, truck B tows the dump truck C, although it is possible to put truck B in neutral and drive the rig from right to left by using the dump truck as a power unit, operating in reverse gear.

FIG. 1 shows that truck B has an engine 31 which drives the rear truck wheels and has a power take off shaft 33. The latter is connected through clutches (not shown) to the conveyors 21 and a shaft 35 on truck B. When the rock spreader is attached to the truck B, the shaft 35 is used for driving the metering mechanism of the rock spreader by means of a chain 37. However, when my attachment is mounted on the truck B, the power take off shaft 35 drives a sprocket on my attachment. The sprocket drives a cross feed auger to be presently described.

Figure 4:
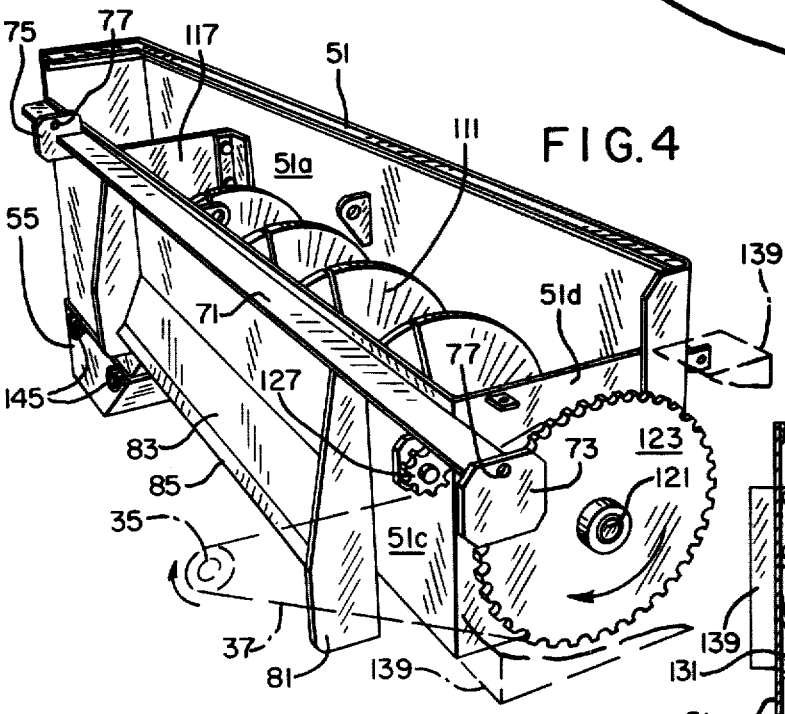
FIG. 4 is a perspective view of the attachment.

Referring to FIGS. 2 and 4, my attachment comprises a cross trough 51 terminating at its right hand end, as the parts are shown in FIG. 2, in a chute 53, the chute terminating in a detachable snout portion 55 which delivers the crushed rock onto the shoulder S.

Figure 5:
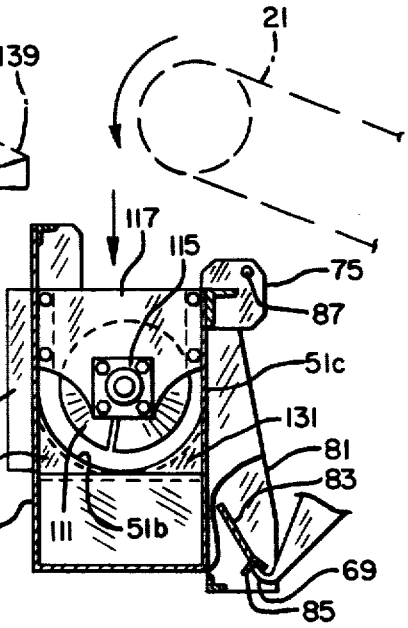
FIG. 5 is a cross sectional view of the attachment taken in the direction of the arrows 5—5 of FIG. 2.

Referring to FIG. 5, the trough 51 is shown as having a front wall 51*a*, a semi-cylindrical bottom wall 51*b* and a rear wall 51*c* suitably welded together.

The method of mounting attachment A onto the front of the truck B is as follows: the truck has a pair of side frame members, one at 61 being shown in FIG. 1. Each side frame member has a mounting plate 63 secured to the frame member in fixed lateral offset relation to provide a mounting slot at each side of truck B. The mounting plates and associated frame members are each provided with an inverted L-shaped bolt slot 65. A nut and bolt unit 67 is received in each pair of bolt slots and can be moved from an upper unlocked position, forwardly and then downwardly, to trap a pair of upstanding lugs (not shown) provided on the rear of the conventional rock spreader within the mounting slots. The spreader has a downwardly projecting support foot (not shown) adapted to seat on an upwardly projecting flange hook 69 (FIG. 5) provided on the frame of truck B. Thus with the weight of the rock spreader resting on the hook flange 69 and the upwardly located ears being entrapped by the bolts 67, the rock spreader is held in its operative position on the front of the truck B.

When the conventional rock spreader is removed, by shifting the bolts 67 upwardly to release the mounting lugs, the front end of the truck B is now in condition for receiving my attachment. To facilitate this, I provide a mounting bar 71 (FIGS. 3 and 4) on the rear of the attachment. This bar carries a pair of laterally spaced mounting plates 73 and 75, which are provided with mounting openings 77 (FIG. 4). My attachment is also provided, on its rear face, with a mounting framework 81 (FIG. 4) equipped with a downwardly projecting foot 83 having a divided lower edge 85 (FIG. 5) for engagement with the flange hook 69.

To mount my attachment in place, after the rock spreader has been removed, the bolts 67, previously used to mount the rock spreader in place, are simply moved to their uppermost positions as shown in FIG. 1, my attachment lifted into a position so that the foot 83 can be placed onto the hook 69, and the attachment brought to the vertical, which movement automatically moves the mounting plates 73 and 75 into the mounting slots provided by the plates 63. Now bolts 87 are inserted in the L-shaped mounting slots and through the holes 77 in the mounting plates 73 and 75. Nuts are applied to the bolts to securely mount the attachment in place.

When my attachment is mounted as above described, the trough 51 thereof receives rock delivered by the conveyors 21. The trough is disposed directly beneath the discharge end of the right hand conveyor 21 (FIG. 2) but only partially beneath the discharge end of the left hand conveyor. However, I provide a chute 101 which I detachably mount in place by bolts (not shown) on the associated side frame member 61 of the truck B to guide rock, leaving the left hand portion of the left hand conveyor, into the left hand portion of the trough.

The right hand conveyor 21 discharges rock onto a divider 103 which is provided on the truck B to aid in its spreading function to better distribute the discharged rock onto the metering mechanism of the spreader attachment. In my arrangement, the right hand divider 103 continues its dividing function, but this in no way impairs the operation of my attachment because the portion of the falling rock moving down the left hand face of the divider 101 falls directly into the chute 53, whereas the portion of the rock travelling down the left hand face of the divider 103 is deposited into the trough. A plate 105 (FIG. 2) is detachably mounted on the associated side member 61 and makes certain that crushed rock moving down the right hand face of the divider 103 is not spilled.

There is also a left hand divider 103 for the left hand conveyor 21, provided for the same purpose as the right hand divider. In order to accommodate my chute 101, I remove most of the left hand face of the left hand divider. However, if it is desired to use the spreader attachment, my chute 101, being detachably mounted in place, can be removed, and the removed portion of the left hand divider 103 can be detachably remounted in its original position by bolts (not shown) so that the left hand divider functions the same way as the right hand divider, at the time of use of the spreader attachment. The modification of the left hand divider and the provision for its reattachment, and the provision of mounting holes for the chute 101 in the associated side frame member 61, are the only modifications of the existing equipment that are necessary to accommodate my attachment.

Within the trough is an auger 111 (FIG. 2) mounted by a bearing 113 at its left hand end, and by a bearing 115 at its right hand end. The left hand bearing is carried by an end wall 51*d* of the trough, while bearing 115 is carried by a hanger-like plate 117 secured to the front and rear walls of the trough 51 (compare FIGS. 2 and 5). The shaft 121 (FIGS. 2 and 4) of the auger carries a sprocket 123, which is so positioned as to be in longitudinal alignment (FIG. 3) with the sprocket on the shaft 35. Adjacent the sprocket 123 is an idler sprocket 127 (FIG. 4) for engaging the drive chain 37, the sprocket being carried on the rear wall of the trough 51.

FIG. 5 shows that a pair of gussets 131 are provided at the right hand end of the lower semi-cylindrical trough portion 51*b*, to fill in the open spaces that otherwise would exist between such lower portion and the floor of the chute 53. Thus, rock delivered to the trough will be conveyed from left to right as the parts are shown in FIG. 2 and deposited into the chute 53, which conducts the material further to the right as the parts are shown in FIG. 2 so they enter the snout 55 for accurate deposit on the shoulder S.

FIGS. 2 and 4 show that there is a case 139 for protecting the sprocket 123 and the portion of the drive chain around the sprocket.

Figure 6:
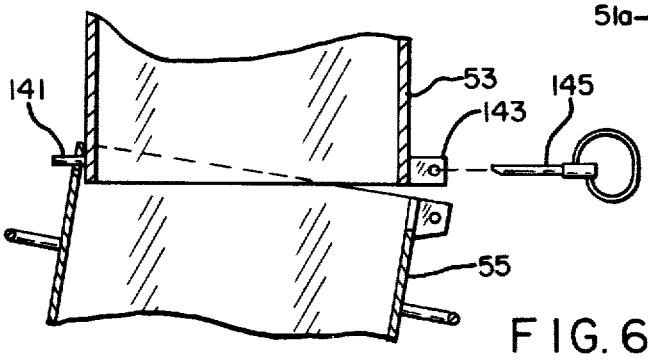
FIG. 6 is a fragmentary vertical sectional view taken along lines 6—6 of FIG. 2, showing the snout of the chute partially detached.

FIGS. 2 and 6 show that the lower portion of the chute 53 has a pair of pins 141 to receive loosely in a pair of holes provided in the upper end of the snout 55. The opposite side of the snout and the lower portion of the chute are provided with ears 143 to receive pins 145 to releasably hold the snout in place. Removal of the pins 145 enables the snout to be quickly detached, facilitating ready travel of the rig from one project to another, without danger of damaging the chute and snout by the latter's encounter with terrain and objects of a more pronounced and rougher nature that would be encountered during a typical operation of applying rock to the shoulder of a road.

The truck B is provided with a pair of catwalks 146 (FIG. 1) one at either side to be used by an attendant on the vehicle. The catwalk enables the attendant to actuate a hitch control lever 147 to raise or lower the hook-like hitch 11. There is also an auger control lever 149 for controlling the clutch between the power take off shaft 33 and the shaft 35 for driving the auger. There is further provided levers 151 and 153 for controlling the clutches for the two conveyors 21.

Referring to FIG. 2, if only light application of crushed rock to a shoulder is desired, the operator will leave the left hand conveyor 21 inactive, while activating the right hand one, which deposits the crushed rock more directly into the chute 53. If a heavier application of crushed rock is desired on the shoulder, both conveyors can be operated. Of course the amount of shoulder rock deposited can be varied by varying the speed of the truck B, but the control levers 151 and 153 give an additional measure of control. A hand rail 155 is typically provided on the truck B to enable the attendant to grasp it while leaning over to observe the operations taking place inside the trough 51.

What is claimed is:

1. An apparatus comprising, a vehicle having a frame having a front end and a rear end, wheels supporting said frame, said frame having a rear portion projecting beyond the associated wheels and a front portion projecting beyond the associated wheels, receptacle means mounted on said rear portion beyond the associated wheels for receiving crushed rock, conveyor means for conducting crushed rock from said receptacle to the front portion of said frame beyond the associated wheels, a trough at said front end for receiving crushed rock directly from the conveyor means, said trough extending from one side to the other of said vehicle and extending beyond said other side to provide an outboard end, driven means in said trough for conveying said crushed rock laterally, chute means mounted directly on said outboard end for receiving crushed rock from the last named means and directing it to a predetermined area to one side of said vehicle, means for detachably mounting said trough on said front end portion of said frame in a position underlying the upper end of said conveyor means, power means on said vehicle, and detachable coupling means drivingly connecting said driven means in said trough to said power means.

2. An apparatus comprising, a wheeled vehicle having a conveyor means for conducting crushed rock from one end thereof to the other, a trough at said other end for receiving crushed rock directly from the conveyor means, said trough extending from one side to the other of said vehicle and extending beyond said other side to provide an outboard end, means in said trough for conveying said crushed rock laterally, and chute means mounted directly on said outboard end for receiving crushed rock from the last named means and directing it to a predetermined area to one side of said vehicle, said trough comprising an attachment detachably secured to said vehicle, said attachment including a pair of ears on the trough and a depending foot support.

3. A side delivery attachment for a wheeled crushed rock vehicle having a front end and a rear end and adapted to travel along a road near a shoulder thereof, said attachment comprising an elongate trough to receive crushed rock, means for detachably mounting said trough at one end of said vehicle in crosswise relationship with respect thereto and disposed beyond the wheels of said vehicle, said trough extending from one side to the other and beyond said other side of said vehicle to provide an outboard end, auger means in said trough to conduct crushed rock therealong, a chute mounted directly on said outboard end of said trough for receiving crushed rock from said auger, said chute being located laterally beyond the associated wheels of the vehicle to deposit the crushed rock on the shoulder of the road, and detachable means for detachably coupling said auger to a power means on the vehicle.

4. An attachment as recited in claim 3 in which said chute has a detachable lower snout portion mounted so as to be readily removable to facilitate travel of the vehicle from one project to another.

5. An attachment as recited in claim 3 in which said auger means terminates short of the full lateral extent of said chute.

6. A side delivery attachment for a wheeled crushed rock vehicle having a front end and a rear end and adapted to travel along a road near a shoulder thereof, said attachment comprising a trough to receive crushed rock, means for mounting said trough on said vehicle laterally of the same, said trough extending from one side to the other and beyond said other side of said vehicle to provide an outboard end, auger means in said trough to conduct crushed rock therealong, a chute mounted directly on said outboard end of said trough for receiving crushed rock from said auger, said chute being located laterally beyond the associated wheels of the vehicle to deposit the crushed rock on the shoulder of the road, the mounting means comprising a pair of ears on said trough securable by bolts to said vehicle, and further including a depending support foot for abutting engagement with a portion of said vehicle.

* * * * *